US007156150B2

(12) United States Patent
Zahedi et al.

(10) Patent No.: US 7,156,150 B2
(45) Date of Patent: Jan. 2, 2007

(54) TWO-ROLL CASTING DEVICE

(75) Inventors: Michael Zahedi, Linz (AT); Thomas Stepanek, Vienna (AT); Gerald Hohenbichler, Kronstorf (AT); Franz Plöckinger, Wels (AT); Karl Klima, Pucking (AT)

(73) Assignee: Voest-Alpine Industrieanlagenbau GmbH & Co. (AT)

( * ) Notice: Subject to any disclaimer, the term of this patent is extended or adjusted under 35 U.S.C. 154(b) by 0 days.

(21) Appl. No.: 10/555,564

(22) PCT Filed: Apr. 22, 2004

(86) PCT No.: PCT/EP2004/004264

§ 371 (c)(1),
(2), (4) Date: Dec. 7, 2005

(87) PCT Pub. No.: WO2004/098814

PCT Pub. Date: Nov. 18, 2004

(65) Prior Publication Data

US 2006/0118270 A1 Jun. 8, 2006

(30) Foreign Application Priority Data

May 6, 2003 (AT) ..... A 678/2003

(51) Int. Cl.
*B22D 11/06* (2006.01)
*B22D 11/08* (2006.01)

(52) U.S. Cl. ..... 164/480; 164/483; 164/428

(58) Field of Classification Search ..... 164/428, 164/480, 483
See application file for complete search history.

(56) References Cited

U.S. PATENT DOCUMENTS

| | | | | |
|---|---|---|---|---|
| 2002/0036073 | A1 | 3/2002 | Takeuchi et al. | 164/475 |
| 2004/0040689 | A1 | 3/2004 | Marti et al. | 164/480 |
| 2004/0244940 | A1* | 12/2004 | Nakayama et al. | 164/428 |
| 2005/0077024 | A1 | 4/2005 | Hohenbichler et al. | 164/428 |
| 2005/0236134 | A1* | 10/2005 | Poloni et al. | 164/480 |

FOREIGN PATENT DOCUMENTS

| | | |
|---|---|---|
| AT | 411 822 B | 6/2004 |
| EP | 0 726 112 A1 | 8/1996 |
| WO | WO 01/39914 A1 | 6/2001 |
| WO | WO 02/11924 A1 | 2/2002 |

* cited by examiner

*Primary Examiner*—Kuang Y. Lin
(74) *Attorney, Agent, or Firm*—Ostrolenk, Faber, Gerb & Soffen, LLP

(57) ABSTRACT

A two-roll casting installation with two casting rolls which rotate in opposite directions about horizontal axes and forming a casting gap for forming and discharging a thin cast metal strip. A sealed housing which has a base and surrounds a conveying path for the metal strip which leaves the casting gap and which strip is from a vertical casting direction into an approximately horizontal conveying direction. Diverter devices divert the metal strip within the housing. A displaceable scrap collection container removes scrap and scale produced from the two-roll casting installation. To minimize the penetration of external air into the housing, the base of the housing, at least in a subregion, forms a collection trough for the scrap, which is part of an emptying device, and a displaceable scrap collection container is arranged in a receiving position below the emptying device.

19 Claims, 6 Drawing Sheets

1
2
3
4
5
6
7
8
9
10
11
13
14
15
16
17
18
19
20
21
22
23
25
27
28
30
41
42
43

TWO-ROLL CASTING DEVICE

CROSS REFERENCE TO RELATED APPLICATION

The present application is a 35 U.S.C. §§ 371 national phase conversion of PCT/EP2004/004264, filed 22 Apr. 2004, which claims priority of Austrian Application No. A678/2003, filed 6 May 2003. The PCT International Application was published in the German language.

BACKGROUND OF THE INVENTION

The invention relates to a two-roll casting installation with two casting rolls which rotate in opposite directions about horizontal axes, with a casting gap for forming and discharging a thin cast metal strip, with a sealed housing which has a base and surrounds the conveying path for the metal strip which leaves the casting gap from a vertical casting direction into an approximately horizontal conveying direction, with diverter devices for diverting the metal strip within this housing, and with a displaceable scrap collection container for removing scrap and scale produced from the two-roll casting installation. The invention also relates to a method for initiating a casting process using the two-roll casting device according to the invention.

Two-roll casting installations are used to produce metal strips, preferably steel strips, with a large strip width and with a strip thickness of less than 10 mm in a continuous casting process. In particular in the case of carbon steels, there is a high likelihood of scaling on contact with oxygen at high temperatures, and consequently the metal melt and the cast metal strip, until the latter has substantially cooled, are passed through a protective gas atmosphere which does not have an oxidizing action.

WO 02/11924 has already disclosed a two-roll casting installation of the generic type. It comprises two casting rolls which rotate in opposite directions about horizontal axes of rotation and, together with side plates which can be placed onto the end sides of the casting rolls, form a melt space and a casting gap, out of which a cast metal strip is discharged vertically downward. The cast metal strip is diverted into the horizontal, so as to form a hanging loop, and then fed to one or more further treatment devices. As it emerges from the casting gap, the hot metal strip passes through a sealed chamber with a protective gas atmosphere, which substantially prevents oxidation processes at the surface of the metal strip. All the openings in this chamber are provided with sealed gates or locks.

The sealed chamber also comprises a space which is open toward the casting rolls for receiving a movable scrap carriage, which, via a lock system which can be flooded with protective gas, can be moved into a receiving position beneath the two casting rolls for the scrap and scale produced and can be removed from this position. To manipulate the scrap carriage, large lock gates have to be opened and large spaces accommodating the scrap carriage have to be flooded with protective gas. Furthermore, complex sealing systems have to be installed for the large lock gates.

Furthermore, WO 02/11924 has disclosed a pivotable guide flap for the cast metal strip, which in an operating position assists with diverting the metal strip into the horizontal and toward a pinch-roll stand and, in a retracted position, allows vertical discharging of a piece of the strand into the scrap bucket. A solution of this type is also known from WO 01/23120.

EP-B 726 112 and WO 01/39914 have disclosed two-roll casting installations of the generic type, in which the cast metal strip is passed through an insulated chamber without integrated base region. The base region is formed by a scrap bucket which can be pressed vertically onto the end sides of the side walls of the insulated chamber and rests on a displaceable scrap carriage such that it can be raised and lowered. A seal is provided between the side walls of the insulated chamber and the edges of the scrap bucket, by means of which seal the insulated chamber is closed off in a substantially gastight manner. When changing the scrap bucket once it has been filled with scrap, the protective gas atmosphere in the insulated chamber through which the metal strip passes is also lost, and it is necessary for the entire chamber to be flooded with protective gas after an empty scrap bucket has been reintroduced; during this operation, it is inevitable that a relatively large quantity of external air and therefore residual oxygen will remain behind. This increases the formation of scale on the metal strip which is subsequently cast for a relatively long period of time, and therefore leads to increased scrap or to adverse consequences for the surface quality of the cast strip. Consequently, the scrap bucket can only be emptied during breaks in production.

SUMMARY OF THE INVENTION

Therefore, it is an object of the present invention to avoid the drawbacks of the known prior art and to propose a two-roll casting installation and a method for initiating a casting process using a two-roll casting installation, by which it is possible to minimize the space which is insulated with protective gas for a hot metal strip to pass through while at the same time allowing continuous collection of scrap and any scale which may be formed without leaks at the housing or at most with only very minor leaks at the housing.

A further object of the invention is to design the two-roll casting installation in such a way that it is possible to remove the collected scrap or scale with very little ingress of air into the insulated housing.

This object which has been set is achieved, according to the invention, by the fact that the base of the housing, at least in a subregion, forms a collection trough for the scrap, which is part of an emptying device, and that a displaceable scrap collection container is arranged in a receiving position below the emptying device.

As a result of a subregion of the housing being configured as a collection trough for scrap which is produced and as a result of the scrap carriage, which takes up a large volume, being arranged outside this housing, it is possible to maintain a small actual collection space for the scrap, with the result that the volume of the housing which has to be flooded with protective gas is also minimized. At the same time, this arrangement offers the possibility of manipulating the scrap carriage independently of the ongoing production process on the two-roll casting installation.

The emptying device comprises at least one collection trough for receiving the scrap, at least one support for this collection trough on a carrying frame or on the housing, which allows actuation of the collection trough between a closed position and an open position, at least one adjustment drive for displacing the collection trough in order to allow it to be emptied, and any seals that may be required in order to prevent external air from entering the housing.

An expedient embodiment consists in the fact that the collection trough for the scrap is designed such that it can be displaced between a closed position and an open position and is coupled to an adjustment drive, and that the housing is assigned a sealing element for sealing a gap between the housing and the collection trough in the closed position. Various embodiments are possible for this purpose. The collection trough may be of single-piece or multipiece design, and the emptying can be effected by a translational movement, preferably of a single-piece design, or by a pivoting movement about one or more pivot axes, preferably of a multipiece design. The collection trough is assigned an adjustment drive, which may be formed by an actuable pressure-medium cylinder or by at least one driven running-mechanism wheel.

The sealing elements which act between the housing and the collection trough are expediently secured to the housing and are designed so that they can be pressed onto the collection trough in the closed position of the latter. This prevents damage to the sealing element during manipulation of the collection trough and in particular during unloading of the scrap.

A preferred configuration of the sealing element consists in the fact that the sealing element comprises a sealing ring, which can move relative to the housing and relative to the collection trough, can be pressed onto the collection trough, is supported by a displacement element acting on the housing and secured to it, and is coupled to a controllable movement device. In this case, the displacement element may be formed, for example, by a bellows or another elastic element which permits longitudinal stretching, and the controllable movement device may be formed, for example, by a pressure-medium cylinder which is articulatedly mounted on the housing.

It is expedient for the collection trough to have a running mechanism, and for this running mechanism to be assigned a running track, in particular rails. By suitably configuring the running track, it is possible, preferably simultaneously with the movement toward the closed position, over the last part of the movement path, to reduce the distance between the collection trough and the housing or the sealing element secured to the housing to such an extent that a closed, sealing position is reached automatically or with a short movement path of the sealing element.

According to an alternative embodiment, the collection trough has sliding elements, and these sliding elements are assigned a stationary slideway. By adopting a suitable configuration of the slideway, it is possible, at the same time as the movement toward the closed position, over the last part of the movement path, to reduce the distance between the collection trough and the housing or the sealing element secured to the housing to such an extent that a closed, sealing position is reached.

If the emptying of the collection trough takes place during a horizontal translational movement of the collection trough, it is advantageous if a clearing board for scraping off the collected scrap in the collection trough is arranged on the housing at a distance from the collection trough. In this case, the distance between the clearing board and the collection trough is selected in such a way that pieces of scrap do not become jammed between the stationary clearing board and the collection trough. The clearing board may in this case rest in a sliding manner on the collection trough. There is provision for it to be possible to retract the clearing board transversely with respect to the translational movement of the collection trough, for emergency situations.

The collection trough comprises a receiving region for receiving the scrap, which may be of various configurations. The receiving region for the scrap may be formed by a planar surface, the associated clearing board having a straight clearing edge which is arranged at a short distance from the surface of the receiving region or slides along it. The receiving region for the scrap may also be shaped as a trough-like recess, this recess preferably being present on three sides of the collection trough, while on the fourth side, at which the emptying of the collection trough takes place, the trough-like recess runs out substantially horizontally.

This also allows emptying with the aid of a clearing board, the clearing edge of which is matched to the cross section of the trough-like recess.

To minimize or substantially avoid the ingress of damaging air into the housing even when the collection trough is in the open position, a sealing element assigned to the housing is designed such that in the open position of the collection trough it can be pressed onto the movable scrap collection container in its receiving position. A further improvement to the sealing can be achieved if, while the operation of moving the collection trough is ongoing, a seal is ensured between the movable scrap collection container and the housing on at least three sides. This is achieved by a multipart sealing element.

To minimize the entry of air, it is in this respect expedient if a sealing element assigned to the housing is designed in such a manner that while the collection trough is opening, it can be pressed continuously or with subsections onto the movable scrap collection container in its receiving position.

According to one possible embodiment, it is possible to minimize the damaging air if the housing is assigned a single encircling sealing element which is designed in such a manner that in the closed position of the collection trough it can be pressed onto the latter and in the open position of the collection trough it can be pressed onto the movable scrap collection container. According to a further highly advantageous embodiment, it is possible to minimize the damaging air if the housing is assigned two sealing elements which are independent of one another, one of these sealing elements being designed such that it can be pressed onto the collection trough in the closed position of the latter, while the second sealing element is designed such that it can be pressed onto the movable scrap collection container. The two sealing elements are preferably secured concentrically with respect to one another on the outer wall of the housing and can be actuated independently of one another.

The remaining introduction of damaging air, which is by now only very slight, can be reduced further if the movable scrap collection container, in its receiving position, is positioned within a closed scrap chamber which adjoins the bottom of the housing in a sealed manner.

Following the conveying path for the cast metal strip, a treatment chamber with a strip conveying device, for example a roller table, and optionally further strip treatment devices for the metal strip, for example a temperature compensation furnace upstream of a rolling stand, adjoin the housing which is flooded with protective gas, in which case the base of this treatment chamber is formed by at least one emptiable collection container for scale and optionally scrap, for example trimming scrap from a strip-trimming installation.

The collection container is preferably designed as a collection trough with a closure device and may be formed, for example, by a funnel-shaped collection hopper with a closure flap.

One or more receiving positions for a movable scrap collection container are provided beneath the collection containers. The movable scrap collection container is equipped with a movement controller which allows it to be moved in a controlled way into all receiving positions below the conveying path for the metal strip. The receiving positions are fixed, for example, by sliding electrical contacts or light barriers.

Using the two-roll casting device according to the invention, the invention proposes an operating method for initiating a casting process, which allows the discharge and removal of a first piece of the cast metal strip from the installation, this piece having been produced in a starting phase without steady-state conditions of the two-roll casting installation and therefore not meeting the quality demands imposed on the product to be produced. In this context, the invention proposes in particular scrap manipulation which as far as possible minimizes the ingress of external air during this starting phase but also allows the subsequent production steps and removal of scrap from the installation with the ingress of air minimized.

In a two-roll casting installation, in which two casting rolls, which rotate in opposite directions about horizontal axes, and side plates which can be pressed onto the casting rolls form a melt space for receiving metal melt and a casting gap for shaping a cast metal strand, metal melt being introduced into the melt space continuously or according to a predetermined start-up curve, and a cast metal strip being discharged from the casting gap continuously or according to a predetermined start-up curve, these advantages are achieved by virtue of the fact that a first piece of the metal strip, which is cast during a starting phase without steady-state conditions, with a diverter device pivoted into a retracted position and with a collection trough displaced into a retracted open position, is passed in a substantially vertical direction directly into the scrap collection container, that when a steady-state operating phase is reached, the first piece of the cast metal strip is cut off, preferably in the casting gap, that the diverter device is then pivoted into the thread-in position, and that the metal strip which is subsequently cast is passed into a substantially horizontal conveying direction and then or at the same time the collection trough is moved into the closed position.

The actual starting procedure can be effected in various ways. In a first step, metal melt is introduced into the melt space up to an operating casting level, and the metal strip starts to be discharged during this filling operation. This operation can begin with the casting rolls stationary or already in rotation. The width of the casting gap may also deviate from an operating casting gap width. Overall, the filling operation in the melt space, the casting rate and the casting gap width can follow a predetermined start-up curve. The first piece, which is produced under casting conditions which are not steady-state conditions, is detached under the force of the weight of this strip section itself. In this case too, the casting rate and the casting gap width can follow a profile curve. A preferred starting method for the casting process in a two-roll casting installation without taking the scrap economics into account has already been described in detail in Austrian patent application AT-A 1367/2002 and should be considered an integral part of the present application.

BRIEF DESCRIPTION OF THE DRAWINGS

Further advantages and features of the present invention will emerge from the following description of nonrestricting exemplary embodiments, in which reference is made to the appended figures, in which.

DESCRIPTION OF THE PREFERRED EMBODIMENTS

Figure 1:
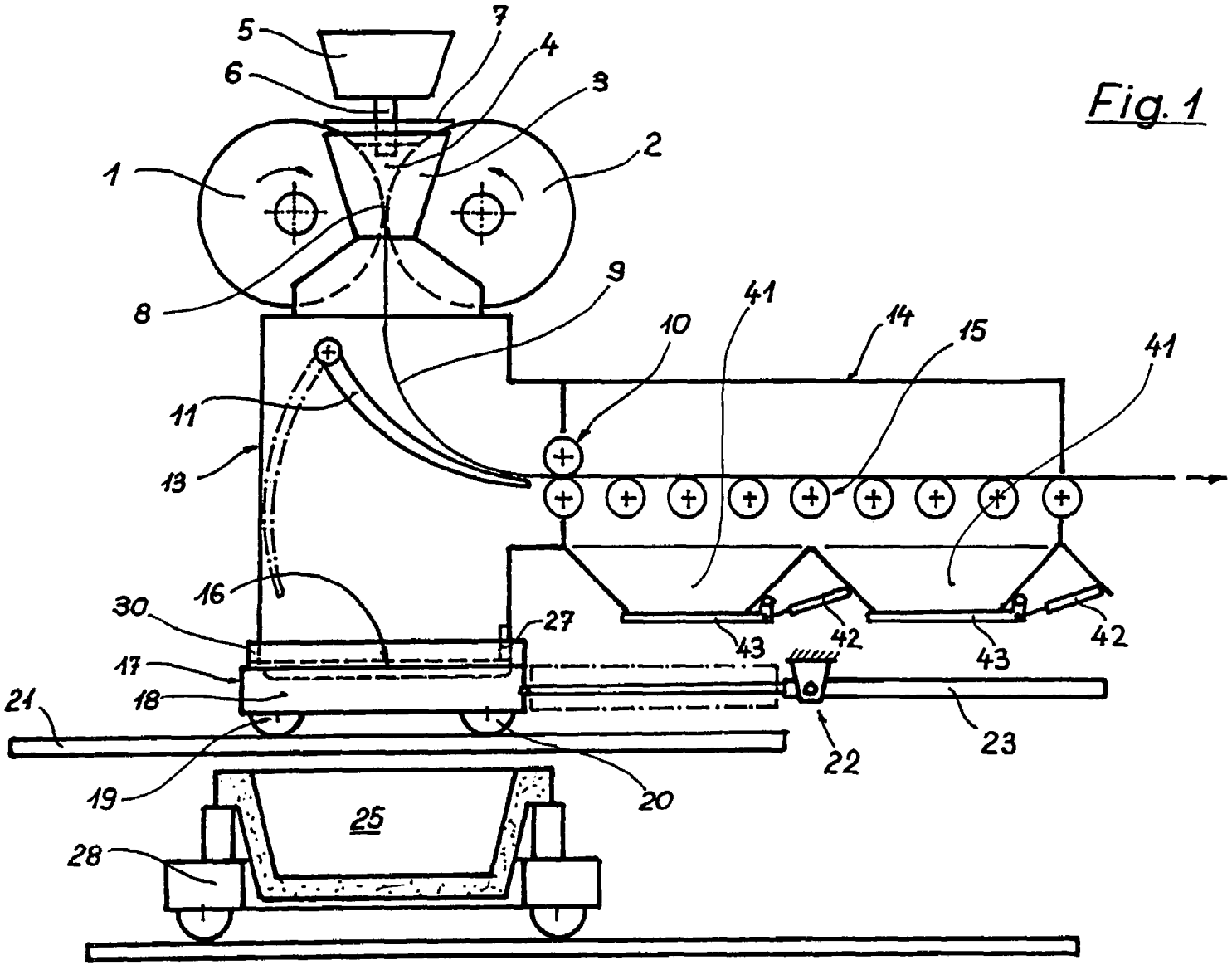
FIG. 1 shows a longitudinal section through a two-roll casting installation with an emptying device according to the invention.

FIG. 1 diagrammatically depicts a two-roll casting installation of the type according to the invention for the continuous production of a steel strip. The core part of the two-roll casting installation for forming the metal strip comprises two driven casting rolls 1, 2 which rotate in opposite directions about horizontal axes and, together with two side plates 3, only one of which is illustrated in FIG. 1, form a melt space 4 for receiving metal melt which is fed into the melt space 4 from a tundish 5 via an immersion pipe 6, where it forms a melt bath. The melt space 4 is closed off in a substantially airtight manner by means of a covering 7, which allows a protective gas atmosphere to be maintained above the melt bath.

The two cooled casting rolls 1, 2 and the side plates 3 which bear against the end sides of the casting rolls form a casting gap 8, from which the metal melt, which has previously solidified in the form of strand shells at the casting-roll surfaces, is discharged in the vertical casting direction as a cast metal strip 9 before being diverted into a horizontal conveying direction and fed by a pinch-roll stand 10 to various further processing devices in the direction indicated by the arrow. A pivotable diverter device 11 in runner form is provided beneath the casting gap 8 to divert the metal strip 9 into the horizontal conveying direction, which diverter device can be pivoted from a thread-in position, which is indicated by solid lines and in which the metal strip 9 is diverted toward the pinch-roll stand 10, into a substantially vertical retracted position, which is indicated by dot-dashed lines. In this retracted position, strip sections as are produced in particular at the start and end of casting can be disposed of vertically downward as scrap.

The conveying path for the metal strip 9 from the exit from the casting gap 8 to entry into the pinch-roll stand 10 is surrounded by a housing 13, which is usually formed by sheet-metal walls with a refractory lining on their inner side. In the region where the metal strip enters the housing 13, seals (not shown), as described in Austrian patent application AT-A 303/2002, are provided between the wall of the housing and the casting rolls 1, 2 or the side plates 3. In the region of the pinch-roll stand 10, a treatment chamber 14, which is likewise flooded with protective gas and in which the metal strip is conveyed onward on a roller table 15 and fed to further treatment devices (not shown in more detail), adjoins the housing 13 in a sealing manner. These further treatment devices may, for example, comprise heat treatments of the metal strip in a strip edge heating device or in a temperature compensation furnace or mechanical treatments of the metal strip in a strip trimming installation or in rolling stands.

An emptying device 17 forms the base 16 of the housing 13 and in a region below the casting gap 8 is formed by a collection trough 18, in which short strip sections which drop down having been separated out of the production process and any scale which drops off the cast metal strip are collected. In particular, the first piece of the cast metal strip formed at the start of casting during a starting phase which lacks steady state conditions does not satisfy the product requirements and is therefore at least partially not diverted into the horizontal conveying direction for further processing toward the first pinch-roll stand, but rather is discharged directly vertically downward into the collection trough 18. The collection trough 18 has a tub-shaped receptacle for the scrap and is equipped with a running mechanism 19 which comprises running wheels 20 which roll along a running track 21 formed by a horizontal longitudinal carrier or a rail. The collection trough 18 can be displaced from a closed position, represented by solid lines, for receiving the scrap into a retracted, open position, indicated by dot-dashed lines, by means of an actuable movement device 22 which is linked to the collection trough and is formed by a pressure-medium cylinder 23 with a long stroke. During the translational movement into the open position, the scrap which has been collected is removed from the collection trough by a clearing board 27, which is arranged at a short distance above the collection trough 18, transversely with respect to its direction of displacement, and this scrap is then transferred into a scrap collection container 25 which is provided below. The scrap collection container is placed in a traveling frame 28 and can be manipulated independently of the ongoing production process at the two-roll casting installation.

Alternatively, it is also possible for the running wheels 20 to be equipped with a running drive (not shown in more detail).

To ensure that the seal between the housing 13 and the collection trough 18 or the housing 13 and the movable scrap collection container 25 during the retracting movement of the collection trough is as complete as possible in virtually all operating phases of the two-roll casting installation, an adjustable sealing element 30 is arranged between these components. One possible embodiment is diagrammatically depicted in partial section in FIG. 2.

Figure 2:
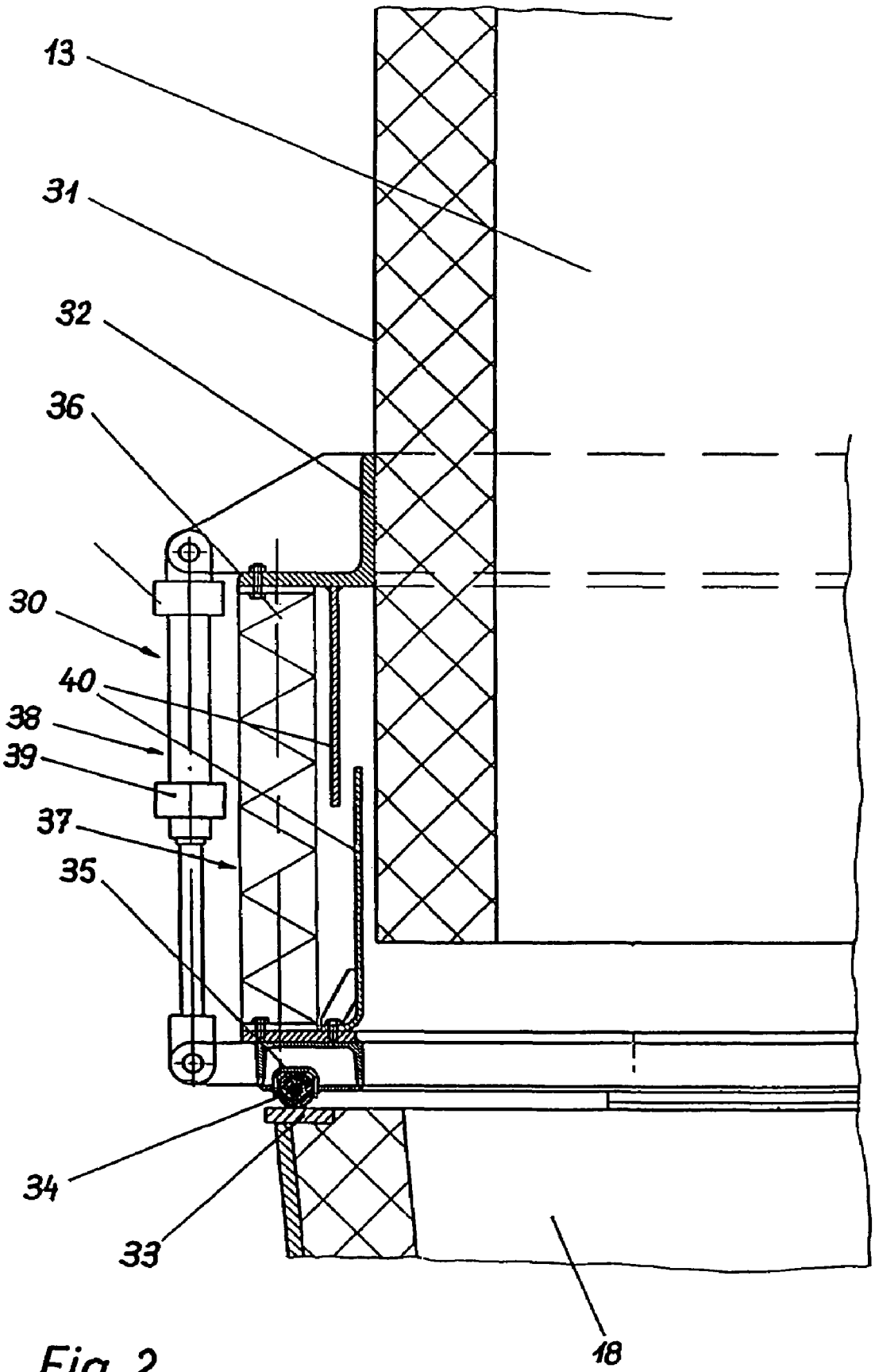
FIG. 2 shows an embodiment of a sealing element between the housing and a collection trough or a scrap collection container.

FIG. 2 shows a partial region of the lower end of the housing 13 and the collection trough 18 for the scrap positioned at a distance beneath it. An encircling bearing flange 32 for the sealing element 30 to be secured to is welded to the outer wall 31 of the housing or its load-bearing structure. A sealing ring 34, which is placed and secured in a sealing ring bearing frame 35, bears against a metal support plate 33 of the collection trough 18, which forms a sealing surface. Between the bearing flange 32 and the sealing ring bearing frame 35 is arranged a displacement element 37 for the sealing ring bearing frame 35, which permits a change in length, is formed by a bellows 36 and is secured in a sealing manner on one side to the bearing flange 32 and on the other side to the sealing ring bearing frame 35. Synchronously controllable movement devices 38, which are formed by pressure-medium cylinders 39, are arranged at a plurality of positions, distributed over the circumference of the housing 13, between the bearing flange 32 and the sealing ring bearing frame 35, by means of which movement devices 38 the sealing ring 34 can be pressed onto the metal support plate 33 of the collection trough 18 in the closed position of the collection trough or lifted off the latter when the collection trough is to be moved into the open position in order to be emptied. To protect the bellows 36 from thermally and mechanically induced damage, telescopic metal protection sheets 40 are secured both to the bearing flange 32 and to the sealing ring bearing frame 35 between the bellows and the outer wall 31 of the housing 13.

The sealing ring 34 is made from an elastic material, such as woven fabric, fiber material or the like. However, it may also be replaced by a different type of seal, such as for example a sand seal, in which case the metal support plate on the collection trough is designed as a tub-shaped receptacle for sand and instead of the sealing ring a metal sealing plate is submerged in this bed of sand in the closed position of the collection trough. The height of the metal sealing plate can once again be adjusted by means of a displacement element, such as a pressure-medium cylinder.

Figure 3:
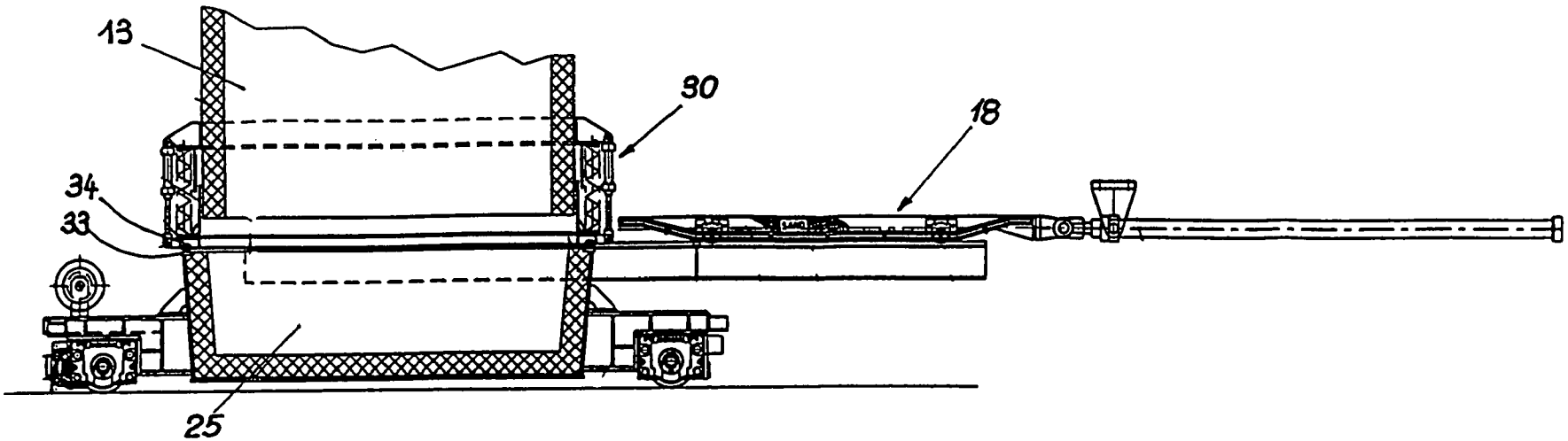
FIG. 3 shows a first operating situation of the two-roll casting installation according to the invention.
Figure 4:
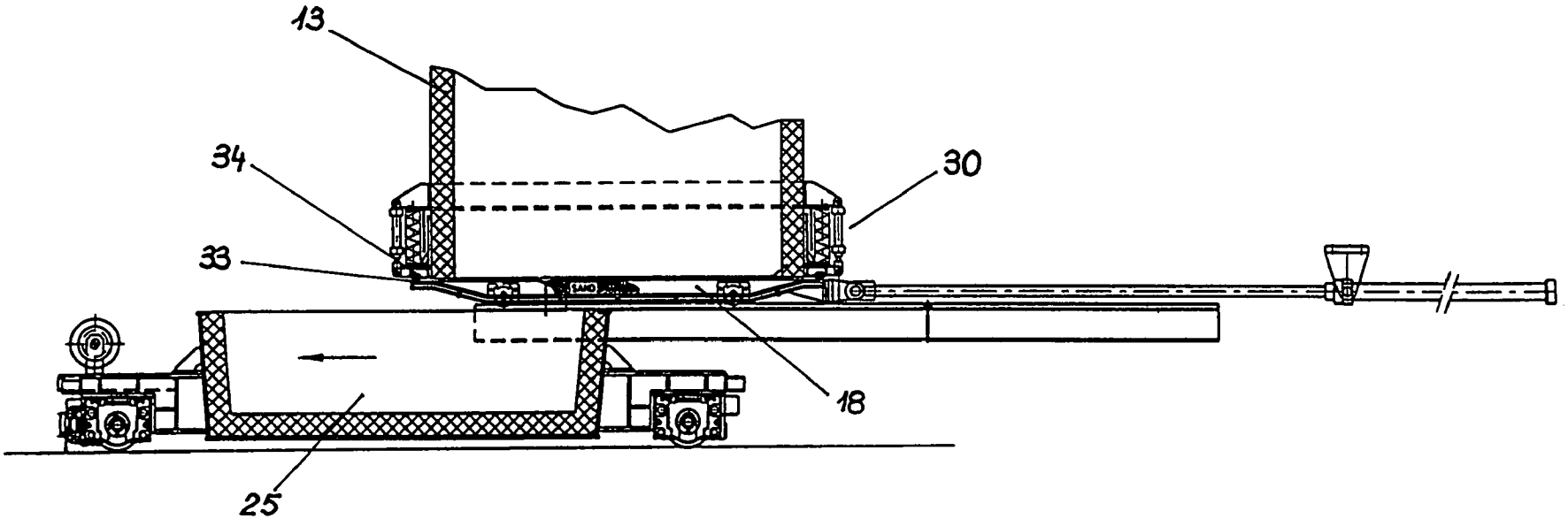
FIG. 4 shows a second operating situation of the two-roll casting installation according to the invention.
Figure 5:
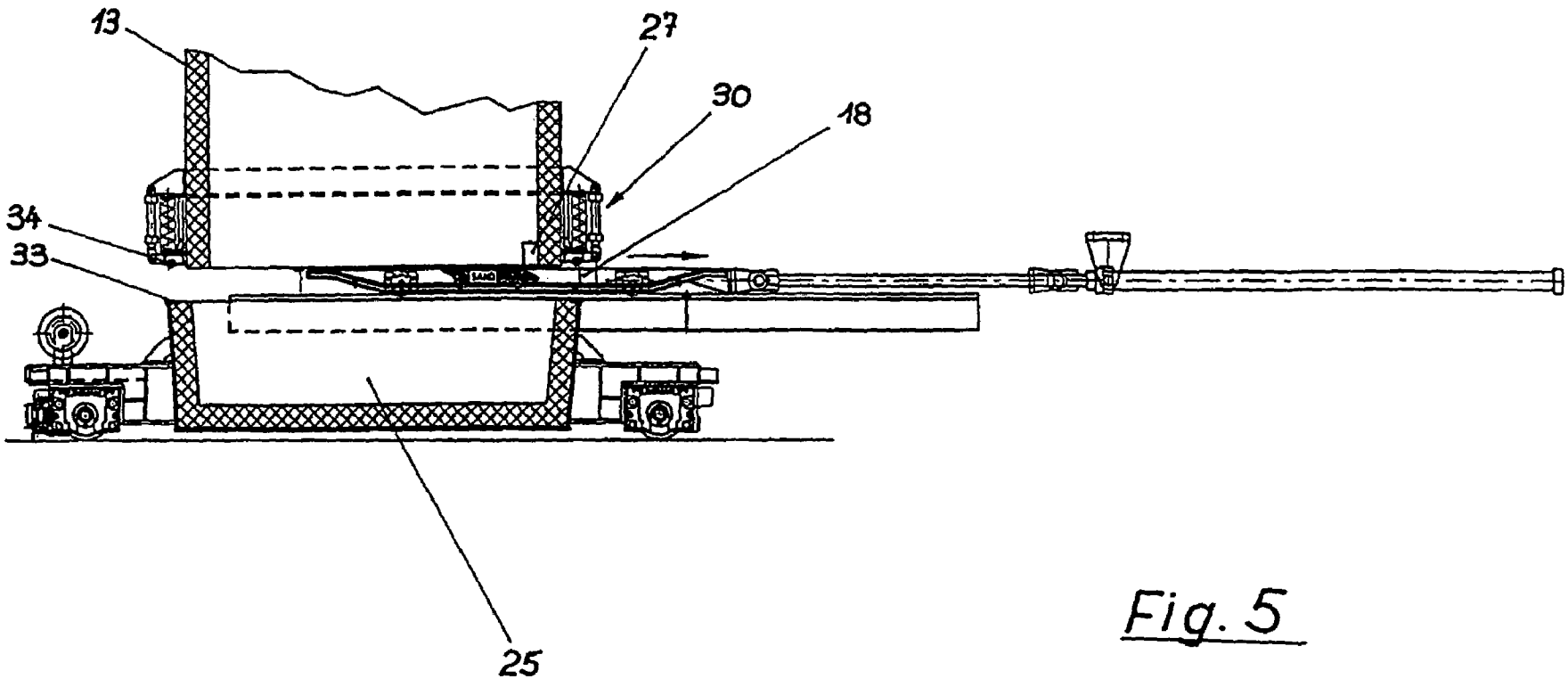
FIG. 5 shows a third operating situation of the two-roll casting installation according to the invention.

The same seal can be used to produce not just a sealing connection between the housing and the collection trough, but also, in the open position of the collection trough, a sealing connection between the housing 13 and the movable scrap collection container 25, as illustrated in FIGS. 3–5.

Figure 6:
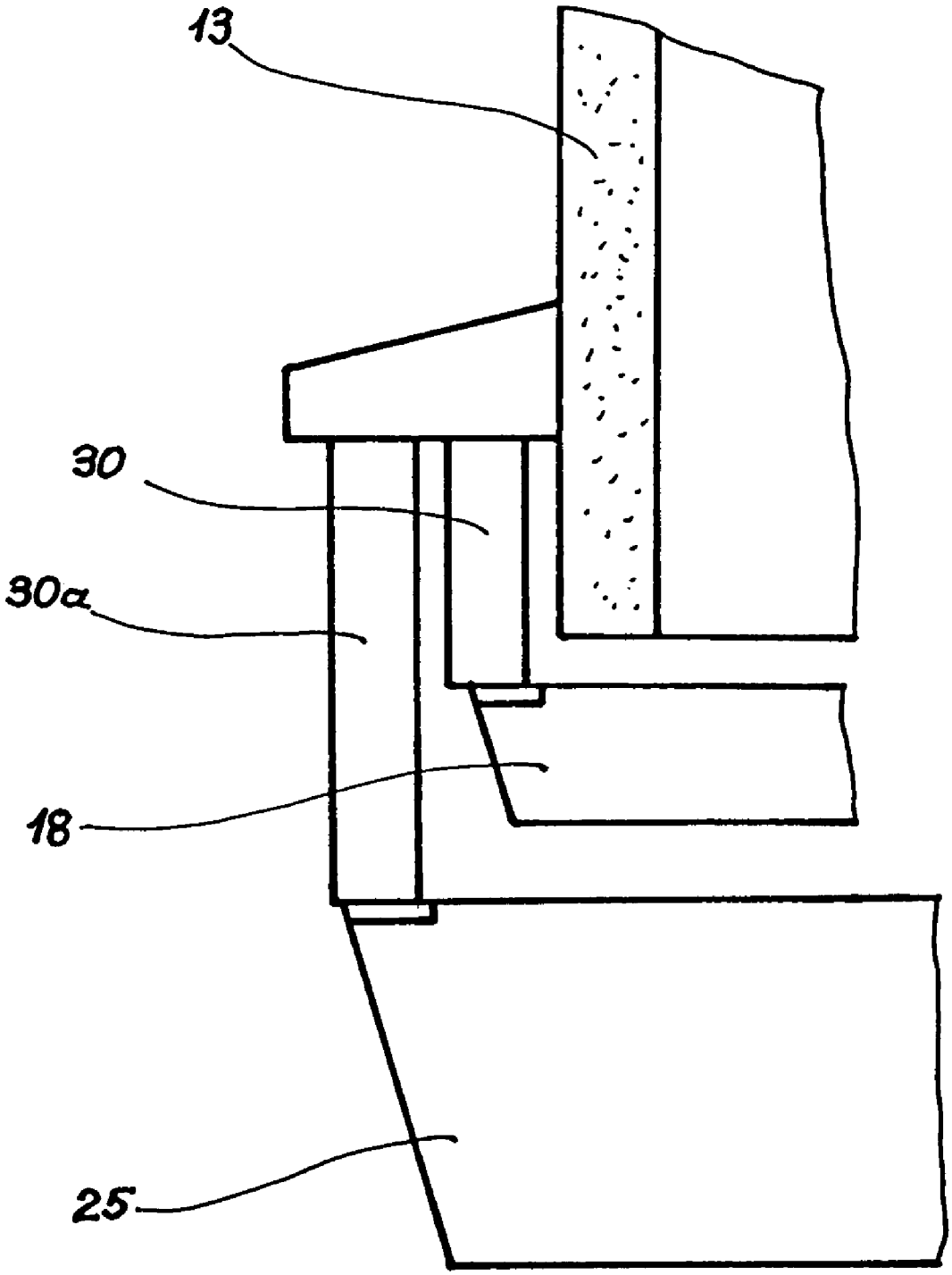
FIG. 6 shows a further embodiment of a sealing element between the housing and a collection trough or a scrap collection container.

FIG. 6, like FIG. 2, illustrates a further embodiment of a seal which is as efficient as possible between the housing 13 and the collection trough 18 arranged beneath it as well as the scrap collection container 25. Two sealing elements 30, 30*a*, which can be actuated independently of one another, are secured to the outer wall of the collection trough 13, the sealing element 30, as has been described with reference to FIG. 2, producing a sealed connection to the collection trough 18, and the further sealing element 30*a*, which is arranged concentrically with respect to this sealing element 30, producing a sealed connection to the scrap collection container 25. The structure of the two sealing elements 30, 30*a* is identical and corresponds to the embodiments shown in FIG. 2. Any other equivalent sealing element can equally be used. On account of this dual arrangement, a sealing connection is retained during all operating situations, either with respect to the collection trough 18 or, on at least three sides, with respect to the scrap collection container 25.

FIGS. 3 to 5 illustrate the arrangement according to the invention of the housing 13, the collection trough 18 and the scrap collection container 25 with respect to one another in three characteristic operating situations. The collection trough 18 is in this case in the shape of a tub, double-walled and of water-cooled design and is filled with sand.

FIG. 3 illustrates an operating situation as occurs in the start-up phase of the casting process. The scrap trough 18 has been moved into the open position, so that the housing 13 is open toward the scrap collection container 25 and pieces of strip which drop down fall directly into the scrap collection container. The sealing element 30 which surrounds the housing 13 on all sides bears, by way of its sealing ring 34, against the metal support plate 33 of the scrap collection container 25 and is in its lowest position of use, closing off the gap space between the housing and the scrap collection container in a sealing manner.

FIG. 4 illustrates an operating situation in which the collection trough 18 adopts the closed position below the housing 13 and the sealing element 30 bears against the metal support plate 33 of the collection trough 18 by means of its sealing ring 34. Any scrap and scale which drop down are collected in the collection trough until the scrap collection container 25 has returned to its receiving position below the closed collection trough after it has been emptied. While the collection trough 18 is in this closed position, the scrap collection container 25 can at any time briefly be moved out of the installation to be emptied without impairing the production process running on the two-roll casting installation.

FIG. 5 illustrates the operating situation in which collected scrap is being emptied out of the collection trough 18 into the scrap collection container. After the sealing element 30, which closes off the gap between the housing 13 and the collection trough 18 in an airtight manner, has been raised into a release position, the collection trough 18 is moved into its open position by means of a transverse movement and at the same time scrap which has collected in the collection trough is pushed into the scrap collection container by means of the clearing board 27. As soon as the collection trough has reached the open position, the sealing element 30 is placed on the scrap collection container. In the case of a sealing element which is segmented along its circumferential extent, it is possible for individual segments to be placed on the scrap collection container immediately after the collection trough has been moved away.

The treatment chamber 14 which immediately follows the housing 13 on the conveying path of the cast metal strip can likewise be flooded with protective gas. As can be seen from FIG. 1, the base of this treatment chamber 14, below the strip conveying device 15, which is formed by a roller table on which the still-hot metal strip is being conveyed, is equipped with two emptiable, funnel-shaped collection containers 41 with closure flaps 43, which can be opened and closed by pressure-medium cylinders 42. A scrap collection container 25 equipped with a movement controller can be moved in sequence both to the emptying position below the closed collection trough 18 and to individual emptying positions below the closure flaps 43 which are opened after the scrap collection container 25 has adopted the respective emptying position. The individual emptying positions are defined by sliding contacts or light barriers.

The invention claimed is:

1. A two-roll casting installation comprising:

two casting rolls which rotate in opposite directions about respective horizontal axes, the rolls being sized and the axes being placed for defining a casting gap between the rolls, the gap being sized for forming and discharging a thin cast metal strip;

supports defining a conveying path for the metal strip, the supports diverting the metal strip which leaves the casting gap from a vertical casting direction into an approximately horizontal conveying direction, the supports comprising diverter devices placed for diverting the metal strip along the conveying path;

a sealed housing which has a base and surrounds the conveying path for the metal strip, the path being within the housing;

a displaceable scrap collection container for removing scrap and scale produced from the two-roll casting installation, the base of the housing, including at least a subregion, which forms a collection trough for the scrap; an emptying device including the trough; and the displaceable scrap collection container arranged in a receiving position below the emptying device.

2. The two-roll casting installation as claimed in claim 1, wherein the collection trough for the scrap is operable to be displaced between a closed position and an open position; and an adjustment device coupled to the trough operable for displacing the trough between the open and closed positions;

a sealing element placed and shaped for sealing a gap between the housing and the collection trough in the closed position of the trough.

3. The two-roll casting installation as claimed in claim 2, wherein the sealing element is secured to the housing and is capable of being pressed onto the collection trough in the closed position of the trough.

4. The two-roll casting installation as claimed in claim 3, wherein the sealing element comprises a sealing ring, which is movable relative to the housing and relative to the collection trough, and the sealing element can be pressed onto the collection trough;

a displacement element, acting on and secured to the housing, and a controllable movement device coupled to be displacement element.

5. The two-roll casting installation as claimed in claim 2, further comprising a running mechanism including a running track and the collection trough is displaceable on the running mechanism.

6. The two-roll casting installation as claimed in claim 2, wherein the collection trough has sliding elements; and the installation further comprises a stationary slideway for the sliding elements.

7. The two-roll casting installation as claimed in claim 2, further comprising a clearing board shaped and positioned for scraping off collected scrap, the clearing board is arranged on the housing spaced at a distance from the collection trough.

8. The two-roll casting installation as claimed in claim 2, wherein the sealing element is shaped and operable such that in the open position of the collection trough, the sealing element can be pressed onto the movable scrap collection container then in the receiving position of the container.

9. The two-roll casting installation as claimed in claim 2, wherein the sealing element is shaped and operable such that while the collection trough is opening, the sealing element can be pressed continuously or with subsections thereof onto the movable scrap collection container in the receiving position of the container.

10. The two-roll casting installation as claimed in claim 2, wherein the sealing element is designed such that in the closed position of the collection trough, the sealing element can be pressed onto the trough, and in the open position of the collection trough, the sealing element can be pressed onto the movable scrap collection container.

11. The two-roll casting installation as claimed in claim 2, further comprising two of the sealing elements which are independent of one another and located at the housing, a first one of the sealing elements being designed such that it can be pressed onto the collection trough in the closed position of the trough, and a second one of the sealing elements can be pressed onto the movable scrap collection container.

12. The two-roll casting installation as claimed in claim 2, further comprising a closed scrap chamber which adjoins the bottom of the housing in a sealed manner, and the movable scrap collection container in the receiving position is positioned within the scrap chamber.

13. The two-roll casting installation as claimed in claim 1, further comprising a treatment chamber with a strip conveying device and optionally including further strip treatment devices for the metal strip, wherein the treatment chamber adjoins the housing and follows the conveying path for the cast metal strip; the treatment chamber has a base formed by at least one emptyable collection container for scale and optionally for scrap.

14. The two-roll casting installation as claimed in claim 13, wherein the collection container comprises a collection trough with a closure device.

15. The two-roll casting installation as claimed in claim 13, further comprising a movable scrap collection container having at least one receiving position and being provided beneath the collection container.

16. The two-roll casting installation as claimed in claim 15, wherein the movable scrap collection container has a movement controller which enables the scrap collection container to be moved in a controlled way into all receiving positions below the conveying path for the metal strip.

17. The two-roll casting installation as claimed in claim 4, wherein the displacement element comprises a bellows.

18. The two-roll casting installation as claimed in claim 4, wherein the controllable movement device comprises a pressure-medium cylinder articulatedly mounted on the housing.

19. A method for initiating a casting process using a two-roll casting installation, wherein the installation includes two casting rolls, which rotate in opposite directions about horizontal axes and the axes are placed to define a casting gap for metal to pass between the casting rolls, and side plates pressed onto ends of the casting rolls to form a melt space for receiving metal melt and the rolls defining a casting gap for shaping a cast metal strand; a diverter device positioned past the casting gap and pivotable between a metal strip diverting position and a retracted position; a collection trough, and a collection container;

the method comprising:

introducing metal melt into the melt space continuously or according to a predetermined start-up curve, and a cast metal strip being discharged from the casting gap continuously or according to the predetermined start-up curve, passing a first piece of the metal strip, which is cast during a starting phase without steady-state conditions, and with the diverter device pivoted into the retracted position thereof and with the collection trough displaced into a retracted open position of the trough, wherein the first piece of the strip is passed in a substantially vertical direction directly into the scrap collection container; and when a steady-state operating phase is reached, cutting off the first piece of the cast metal strip and pivoting the diverter device into a thread-in position, such that the metal strip which is subsequently cast is passed into a substantially horizontal conveying direction; and then or at the same time moving the collection trough into the closed position thereof.

* * * * *